US010837243B2

(12) United States Patent
Magnuson

(10) Patent No.: US 10,837,243 B2
(45) Date of Patent: Nov. 17, 2020

(54) PIPE HANDLING COLUMN RACKER WITH RETRACTABLE ARM

(71) Applicant: Nabors Drilling Technologies USA, Inc., Houston, TX (US)

(72) Inventor: Christopher Magnuson, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/231,137

(22) Filed: Dec. 21, 2018

(65) Prior Publication Data

US 2020/0199949 A1 Jun. 25, 2020

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14; E21B 19/20
USPC ..... 414/22.51–22.71
See application file for complete search history.

(56) References Cited

U.S. PATENT DOCUMENTS

| | | | | |
|---|---|---|---|---|
| 8,936,424 | B1 * | 1/2015 | Barnes | E21B 19/02 414/22.63 |
| 8,949,416 | B1 * | 2/2015 | Barnes | G06F 15/17306 370/229 |
| 9,394,751 | B2 * | 7/2016 | Magnuson | G01G 19/52 |
| 9,732,569 | B2 * | 8/2017 | Loevsland | E21B 19/15 |
| 9,926,753 | B2 * | 3/2018 | Magnuson | E21B 19/14 |
| 9,932,783 | B2 * | 4/2018 | Magnuson | E21B 19/14 |
| 10,053,934 | B2 * | 8/2018 | Keogh | E21B 19/14 |
| 2009/0126941 | A1 * | 5/2009 | Laitolais, Jr. | E21B 19/24 166/377 |
| 2009/0196712 | A1 * | 8/2009 | Mortensen | E21B 19/146 414/22.68 |
| 2016/0060979 | A1 * | 3/2016 | Magnuson | E21B 19/14 414/22.63 |

FOREIGN PATENT DOCUMENTS

| | | | | |
|---|---|---|---|---|
| WO | WO 2015/175093 | * 11/2015 | | E21B 19/08 |
| WO | WO 2016/032577 | * 3/2016 | | E21B 19/15 |

* cited by examiner

*Primary Examiner* — Lynn E Schwenning
(74) *Attorney, Agent, or Firm* — Haynes and Boone., LLP

(57) ABSTRACT

An apparatus for moving a tubular may include a column vertically extending from a drill floor, the column defining an axis; a lower carriage connected to the column and configured to carry the column along the drill floor; an upper arm assembly movable along the column, the upper arm assembly being configured to connect with a tubular; and a lower arm assembly having a lower gripper head configured to attach to the tubular, the lower arm assembly being movable to displace the lower gripper head between a position on a first side of the axis and a position on a second side of the axis.

22 Claims, 13 Drawing Sheets

PIPE HANDLING COLUMN RACKER WITH RETRACTABLE ARM

TECHNICAL FIELD

The present disclosure is directed to drilling rig systems, devices, and methods including a pipe handling racker with a retractable arm.

BACKGROUND OF THE DISCLOSURE

Traditional pipe handling systems known in the industry as column rackers utilize a minimum of two arms for the securing and transporting of tubulars. However, the lower arm of conventional column rackers has limited the travel height of the movable upper arm. That is, interference between the arms prevents the movable upper arm from traveling to the rig floor. To address this, conventional systems include complicated elevators or other mechanisms that hang from the pipe gripper of the movable upper arm to increase the reach in order to allow the movable upper arm to pick up of tubulars from the rig floor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
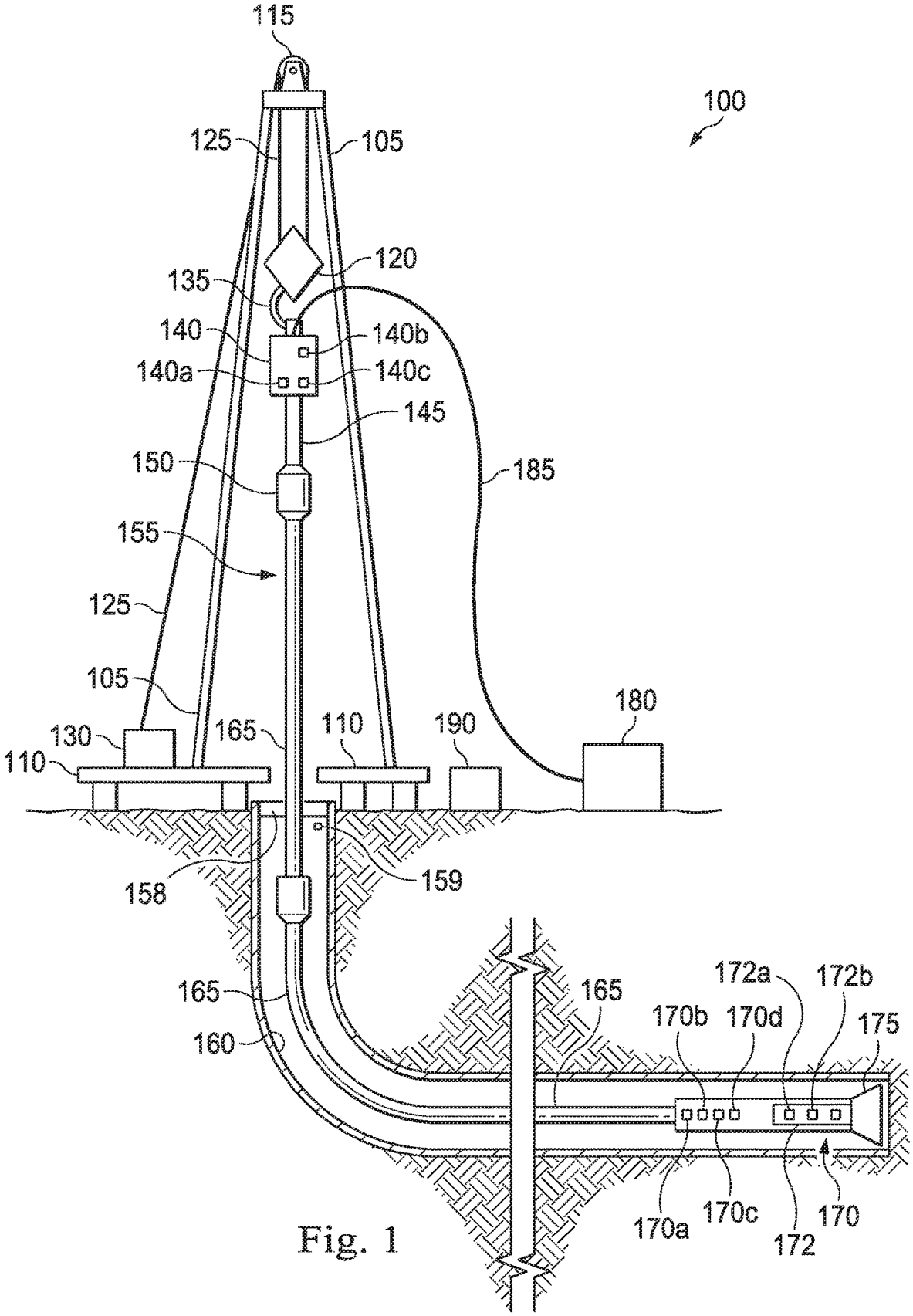
FIG. 1 is a schematic of an exemplary drilling apparatus according to one or more aspects of the present disclosure.

It is to be understood that the following disclosure describes many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods described herein enable movement of a tubular about a drilling rig apparatus in a more simple and secure manner. In some implementations, the systems and methods described herein include allowing a upper arm assembly, such as an upper arm assembly of a column racker to transition to a floor of the drilling rig and secure tubulars without hanging elevators or other mechanisms that may dangle from the upper arm assembly to pick-up tubulars. The arrangement of a lower arm assembly of the column racker permits the lower arm assembly to retract out of the path traveled by the upper arm assembly to allow the upper arm assembly to secure tubulars.

In addition, the current level of automation requires all rig floor equipment to be stopped and placed in a safe state so that rig personnel can perform activities safely. Removing the need to hang additional equipment from the upper arm assembly may reduce or eliminate the need for downtime to remove the hanging equipment. Furthermore, because additional equipment may not need to hang from the upper arm assembly, some implementations may also reduce the likelihood of dropped equipment, which may reduce the likelihood of damage. The systems and methods described herein may possess other advantages and purposes which may be made more clearly apparent from the consideration of the attached implementation.

In some examples, a lower arm assembly of the column racker may be retractable and capable of removing itself from the upper arm's path. The upper arm assembly may be allowed to vertically travel into and below the travel path of the lower arm assembly. In some examples, the upper arm assembly may travel to lower stops, such as mechanical stops, that form a part of the column racker.

In some implementations, the systems and methods described herein may remove stands from a wellbore during tripping and casing operations and may utilize a racker device to sense a length of the tubular and validate the length by securing the tubular beneath a tubular shoulder and placing the stand on a measuring plate, such as the drill floor. The racker device may then be able to provide an accurate length of the tubular, thus being able to identify stands for further review that exceed their original length.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. In some implementations, the BHA 170 includes a bent housing drilling system.

Implementations using bent housing drilling systems may require slide drilling techniques to execute or effect a turn using directional drilling. For slide drilling, the bent housing drilling systems may include a down hole motor with a bent housing or other bend component operable to create an off-center departure of the bit from the center line of the wellbore. The direction of this departure from the centerline in a plane normal to the centerline is referred to as the "toolface angle." The drill bit 175, which may also be referred to herein as a "tool," may have a "toolface," connected to the bottom of the BHA 170 or otherwise attached to the drill string 155. One or more pumps 180 may deliver drilling fluid to the drill string 155 through a hose or other conduit 185, which may be connected to the top drive 140.

In an exemplary implementation, the apparatus 100 may also include a rotating blow-out preventer (BOP) 158 that may assist when the well 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170, the pump 180, and/or a racker device as described herein. The controller 190 may be a stand-alone component installed near the mast 105 and/or other components of the apparatus 100. In an exemplary implementation, the controller 190 includes one or more systems located in a control room in communication with the apparatus 100, such as the general-purpose shelter often referred to as the "doghouse" serving as a combination tool shed, office, communications center, and general meeting place. The controller 190 may be configured to transmit the operational control signals to the drawworks 130, the top drive 140, the BHA 170, the pump 180, and/or the racker device via wired or wireless transmission devices which, for the sake of clarity, are not depicted in FIG. 1.

The apparatus 100 may additionally or alternatively include a shock/vibration sensor **170*b* that is configured to detect shock and/or vibration in the BHA 170. The apparatus 100 may additionally or alternatively include a mud motor pressure sensor 172*a* that is configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172**.

The apparatus 100 may additionally or alternatively include a toolface sensor **170*c* configured to detect the current toolface orientation. The toolface sensor 170*c* may be or include a conventional or future-developed magnetic toolface sensor which detects toolface orientation relative to magnetic north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170**.

The apparatus 100 may additionally or alternatively include a torque sensor **140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotary speed of the quill 145**.

The top drive 140, drawworks 130, crown or traveling block, drilling line or dead line anchor may additionally or alternatively include or otherwise be associated with a WOB sensor **140*c* (WOB calculated from a hook load sensor that can be based on active and static hook load, e.g., one or more sensors installed somewhere in the load path mechanisms to detect and calculate WOB, which can vary from rig to rig) different from the WOB sensor 170***d*. The WOB sensor 140*c* may be configured to detect a WOB value or range, where such detection may be performed at the top drive 140, drawworks 130, or other component of the apparatus 100.

Figure 2:
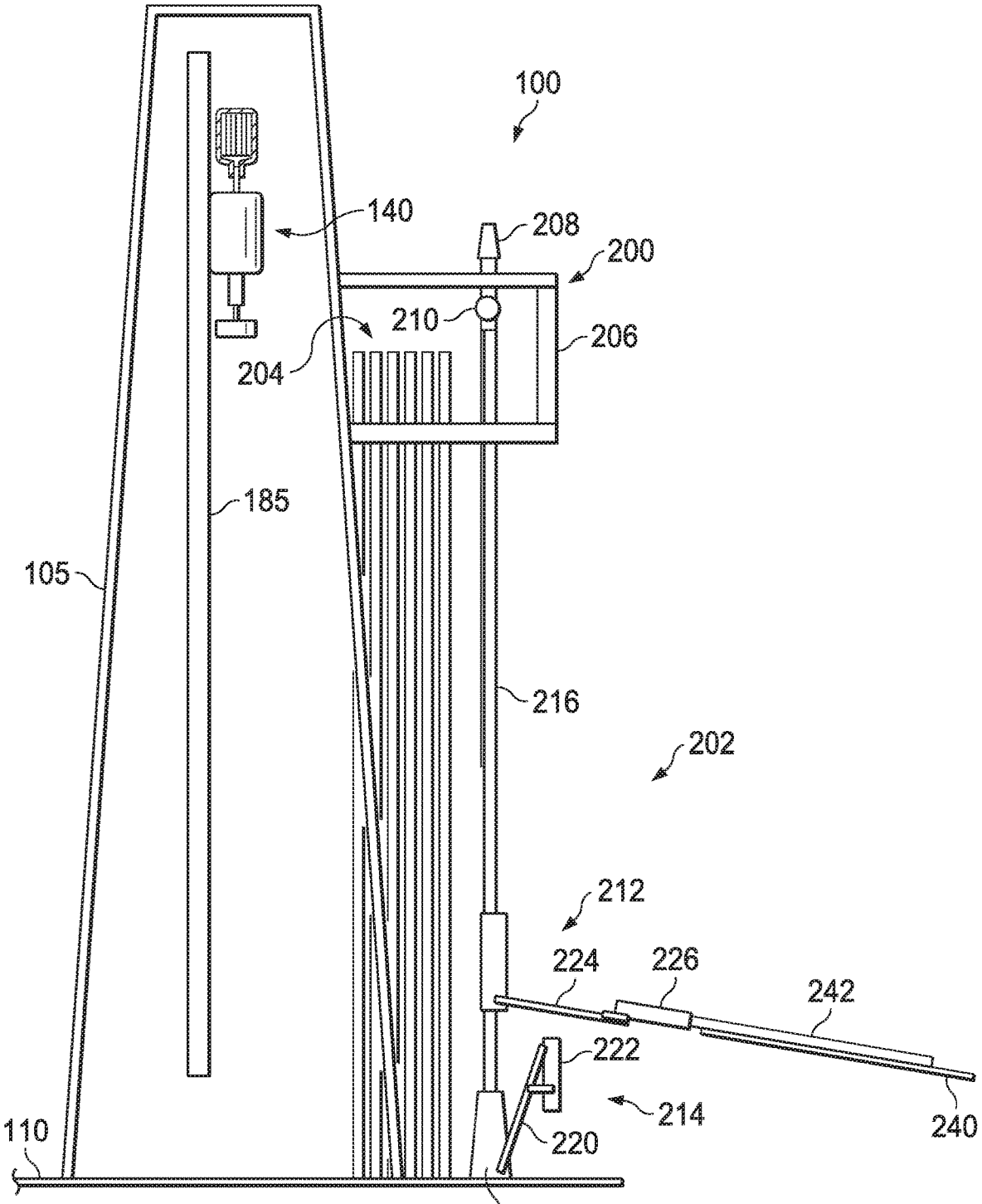
FIG. 2 is a schematic of an exemplary drilling apparatus including a column racker according to one or more aspects of the present disclosure.

FIG. 2 shows the drilling rig apparatus 100 with some additional detail. The mast 105 may support a column 195 along which the top drive 140 may vertically slide as controlled by the drawworks 130. In the implementation shown, the mast 105 also supports a fingerboard 200 and a racker device 202. In this implementation, the fingerboard 200 is a cantilevered fingerboard extending from the mast 105, and may support or hold the pipe stands or tubulars 204 in position. The fingerboard 200 may include a diving board 206 stowed in a vertical position to allow operation of the racker device 202, or may be moved to a horizontal position for more conventional access.

In the implementation shown, the racker device 202 is a column racker supported both at an upper portion and a lower portion. In this embodiment, the racker device 202 is supported by the fingerboard 200 or other support structure at the upper end, and carried on the rig floor 110 at the lower end. Accordingly, the weight of the racker device 202 and any tubulars carried by the racker device is supported at the lower end of the racker device 202. The racker device 202 includes a modular racker upper column drive 208, a modular racker hoist 210, an upper arm assembly 212, a lower arm assembly 214, and a racker support column 216 that extends between the upper column drive 208 and the lower arm assembly 214.

Drill pipe stands or tubulars 204, formed of one or more tubulars may be transferred by the racker device 202 to positions in a mousehole for assembly or disassembly, transferred into and out of the fingerboard 200, transferred into or out of well center, which is disposed above the wellbore 160 (FIG. 1) or moved off of or onto the rig floor.

The racker support column 216 may be formed of a single beam or multiple beams or struts and may be formed of single or multiple lengths joined together. In some embodiments, the racker support column 216 is a structural support along which the upper arm assembly 212 may move upward or downward on wheels. Here, the racker support column 216 extends vertically from the rig floor 110 to the fingerboard 200.

In some exemplary embodiments, the upper column drive 208 is a motorized carriage configured to move the upper portion of the racker support column 216 along the fingerboard 200. In some implementations, it may do this by driving along a track adjacent to or forming a part of the fingerboard 200. The racker hoist 210 may be disposed on the fingerboard or adjacent structure and may be configured to raise and lower the upper arm assembly 212 along the racker support column 216. In some implementations, the racker hoist 210 is a motorized spool that may be in operable engagement with the upper column drive 208 and may be driven by the upper column drive 208. The racker hoist 210 may operate as a winch with a spool and a cable attached to the upper arm assembly 212 to move the upper arm assembly 212 up or down in the vertical direction along the racker support column 216.

The lower arm assembly 214 and the upper arm assembly 212 cooperate to manipulate tubulars and/or stands. The lower arm assembly 214 also includes a drive system that allows the lower arm assembly 214 to displace along the rig floor 110, thereby displacing the racker support column 216. Accordingly, in some implementations, the lower arm assembly 214 may include a drive carriage 218 that may be motorized element that moves along the drill floor, including rails, or tracks that may form a part of the drill floor. The lower arm assembly 214 and the upper arm assembly 212 may respectively include a lower manipulator arm 220 and gripper head 222 and an upper manipulator arm 224 and gripper head 226. The gripper heads 222, 226 may be sized and shaped to open and close to grasp or retain tubing, such as tubulars or stands. The manipulator arms 220, 224 may move the gripper heads 222, 226 toward and away from the racker support column 216. These upper and lower manipulator arms 220, 224 and gripper heads 222, 226 are configured to reach out to insert a drill pipe stand into or remove a drill pipe stand from the fingerboard 200. That is, the upper and lower manipulator arms and gripper heads extend outwardly in the y-direction from the racker support column 216 to clamp onto or otherwise secure a drill pipe stand that is in the fingerboard 200 or to place a drill pipe stand in the fingerboard. As indicated above, the upper arm assembly 212 may operate in a z-direction, or vertical direction, along the racker support column 216. In some aspects, it is operated by the racker hoist 210.

FIG. 2 also includes a catwalk 240 or a feeder slide that may be used to introduce tubulars or stands to the rig floor 110 via a V-door as is known in the art. The upper gripper head 226 of the upper arm assembly 212 may be configured to receive the leading end of a tubular 242 from the catwalk 240. The upper arm assembly 212 may then raise the tubular until it is grasped by the lower gripper head 222 of the lower arm assembly 214. This will be described in greater detail below.

Figure 3:
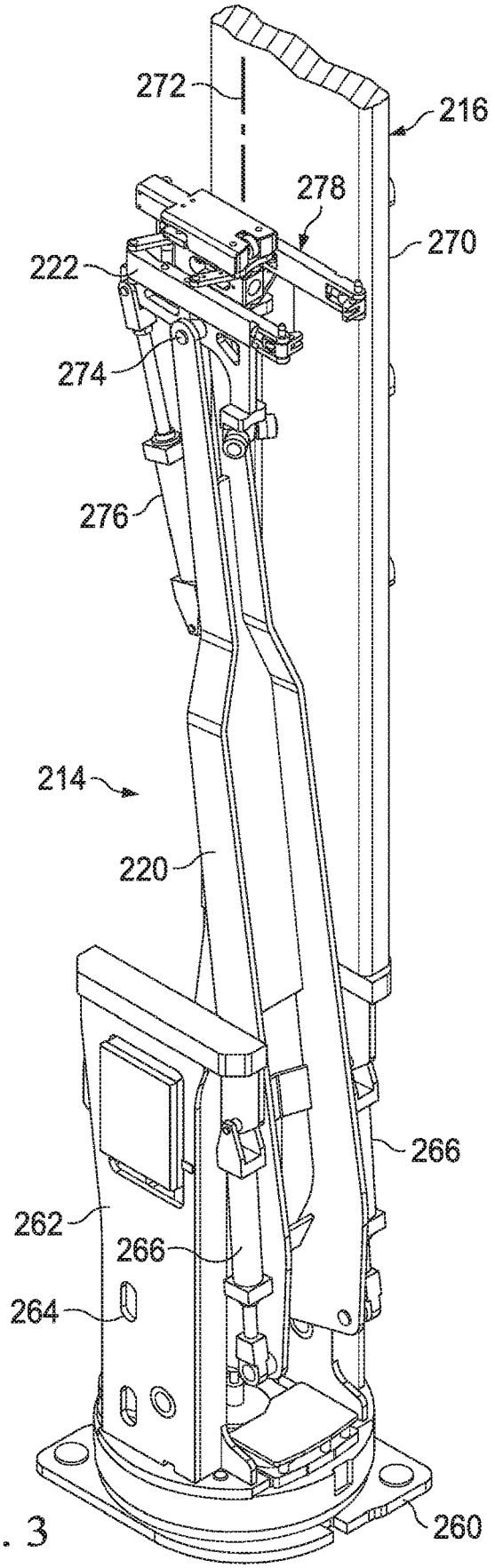
FIG. 3 is a schematic of a perspective view of a portion of the exemplary drilling apparatus according to one or more aspects of the present disclosure.
Figure 4:
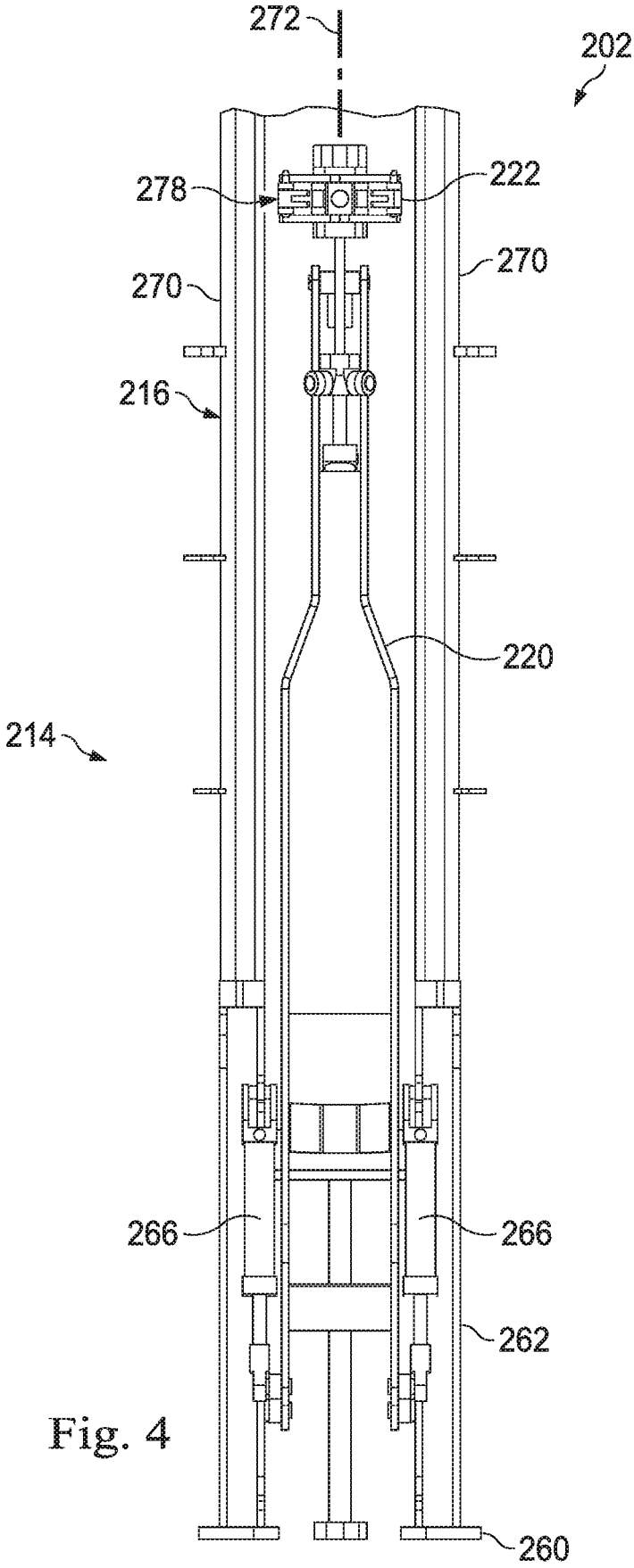
FIG. 4 is a schematic of a front view of a portion of the exemplary drilling apparatus according to one or more aspects of the present disclosure.

FIGS. 3 and 4 show a lower portion of the racker device 202. FIG. 3 shows the lower portion of the racker device 202 with a portion of the racker support column 216 removed. FIG. 4 shows the lower portion of the racker device 202 with the racker support column 216. Referring to FIGS. 3 and 4, the lower portion of the racker device 202 includes the lower arm assembly 214, including a base 260 that interfaces with the drive carriage 218 (FIG. 2), the lower manipulator arm 220, and the lower gripper head 222.

In greater detail, the lower arm assembly 214 also includes an arm support structure 262, an arm pivot portion or fulcrum 264, and actuators 266, shown here as hydraulic cylinders, that allow the manipulator arm 220 and the lower gripper head 222 to pivot about the fulcrum 264. The actuators 266 extend from the manipulator arm 220 to the arm support structure 262, and may be controlled to pivot the manipulator arm 220 about the fulcrum 264. Although identified on the arm support structure 262, the fulcrum 264 may be disposed at any location permitting the manipulator arm to move and operate as will be described herein. As best seen in FIG. 4, the racker support column 216 may be formed of two vertically extending struts 270. In FIG. 3, one of the vertically extending struts 270 has been removed to better show the manipulator arm 220 and the lower gripper head 222. The vertically extending struts 270 extend from the arm support structure 262 to the racker upper column drive 208. In this example, the vertically extending struts are spaced apart from each other, creating a through passage through which the lower manipulator arm 220 and the lower gripper head 222 may pass. The racker support column 216 may have an axis, shown in FIGS. 3 and 4 as axis 272. In some embodiments, the axis 272 may be defined by the central axis of the racker support column 216.

The lower gripper head 222 attaches to the lower manipulator arm 220 via a pivot joint 274 and an actuator 276. In this embodiment, the actuator is a cylinder, however other actuators are contemplated. The gripper head 222 may include jaws 278 configured to receive a tubular. The jaws 278 may open to receive the tubular, and may close to secure or retain the tubular. The gripper head 222 may pivot relative to lower manipulator arm 220 in order to properly receive a tubular regardless of the position of the manipulator arm 220.

Figure 5:
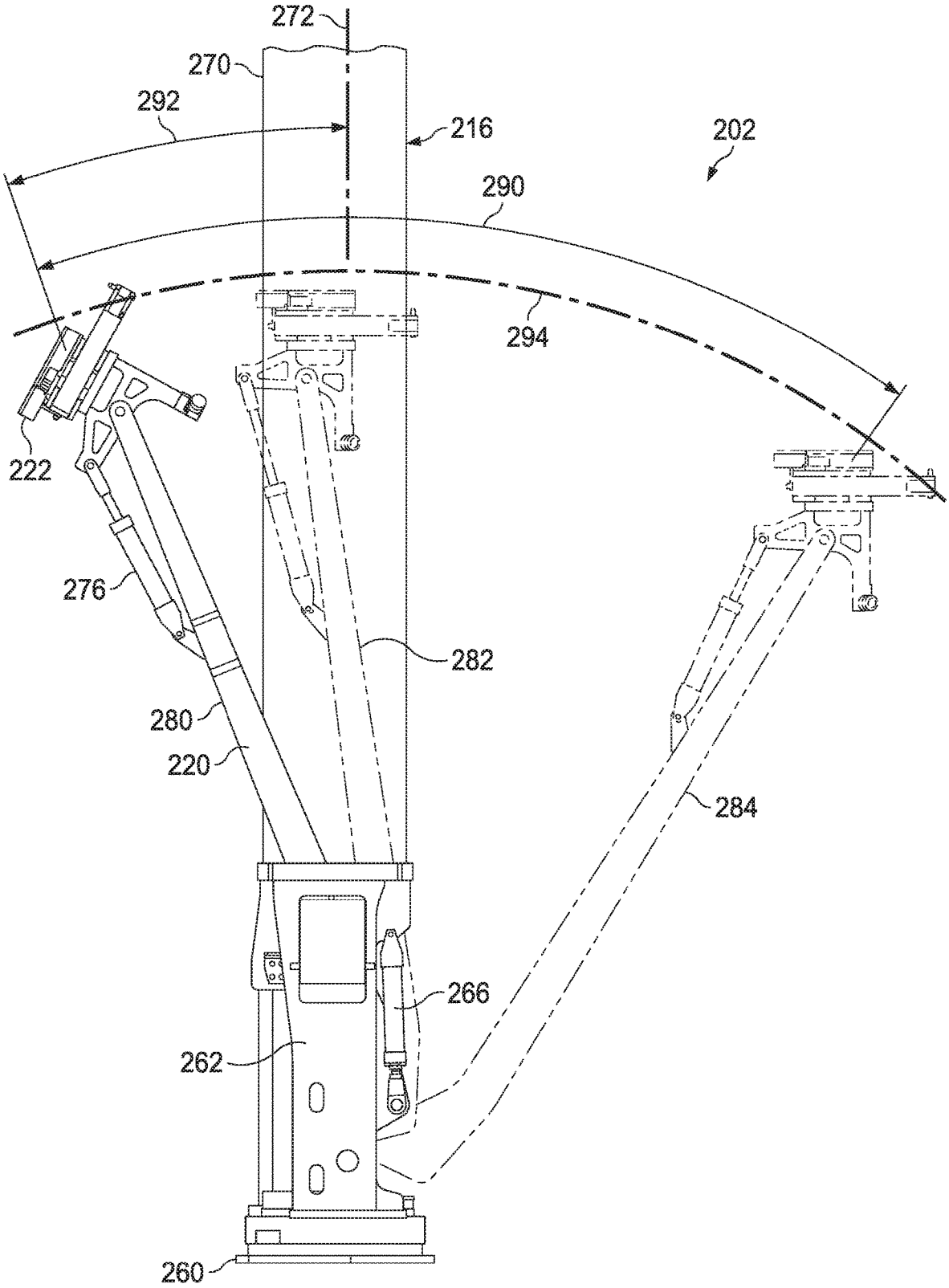
FIG. 5 is a schematic of a side view of a portion of the exemplary drilling apparatus with a lower arm assembly movable through a motion range according to one or more aspects of the present disclosure.

FIG. 5 shows a side view of the lower portion of the racker device 202 showing the range of motion through which the lower manipulator arm 220 and lower gripper head 222 may move. As described above, one of the vertically extending struts 270 is removed for clarity. As can be seen, the lower manipulator arm 220 may move between a retracted position referenced herein as position 280, a central position referenced herein as position 282, and an extended position referenced herein as position 284. The retracted position 280 is a position with both the manipulator arm 220 and the lower gripper head 222 being retracted on one side of the axis 272. The extended position is a position with both the manipulator arm 220 and the lower gripper head 222 being extended on the other side of the axis 272. Accordingly, the range of travel of the manipulator arm 220 and the gripper head 222 extends from a position behind the axis 272 to a position in front of the axis 272. The angle identified by the reference number 290 represents the range of travel of the lower manipulator arm 220. In some embodiments, the angle 290 of the range of travel is greater than 90°. In other embodiments, the angle 290 of the range of travel is in a range of about 90° to about 130°. In yet other embodiments, the range of travel to 90 is in a range of about 60° to about 90°. Other ranges of travel are contemplated. The angle identified by the reference number 292 represents the range of travel of the lower manipulator arm 220 in the rearward or retracted direction. In some implementations, the rearward range of travel is in a range of about 0 to 45°. In other implementations, the range is about 0° to 25°. In yet other implementations, the range is about 10 to 30°. FIG. 5 also shows a travel path of the reach of the manipulator arm 220. This travel path is represented by the reference number 294, and may be determined based on the travel path of a single point on the lower manipulator arm 220 or lower gripper head 222 as they travel through the range of motion.

Figure 6:
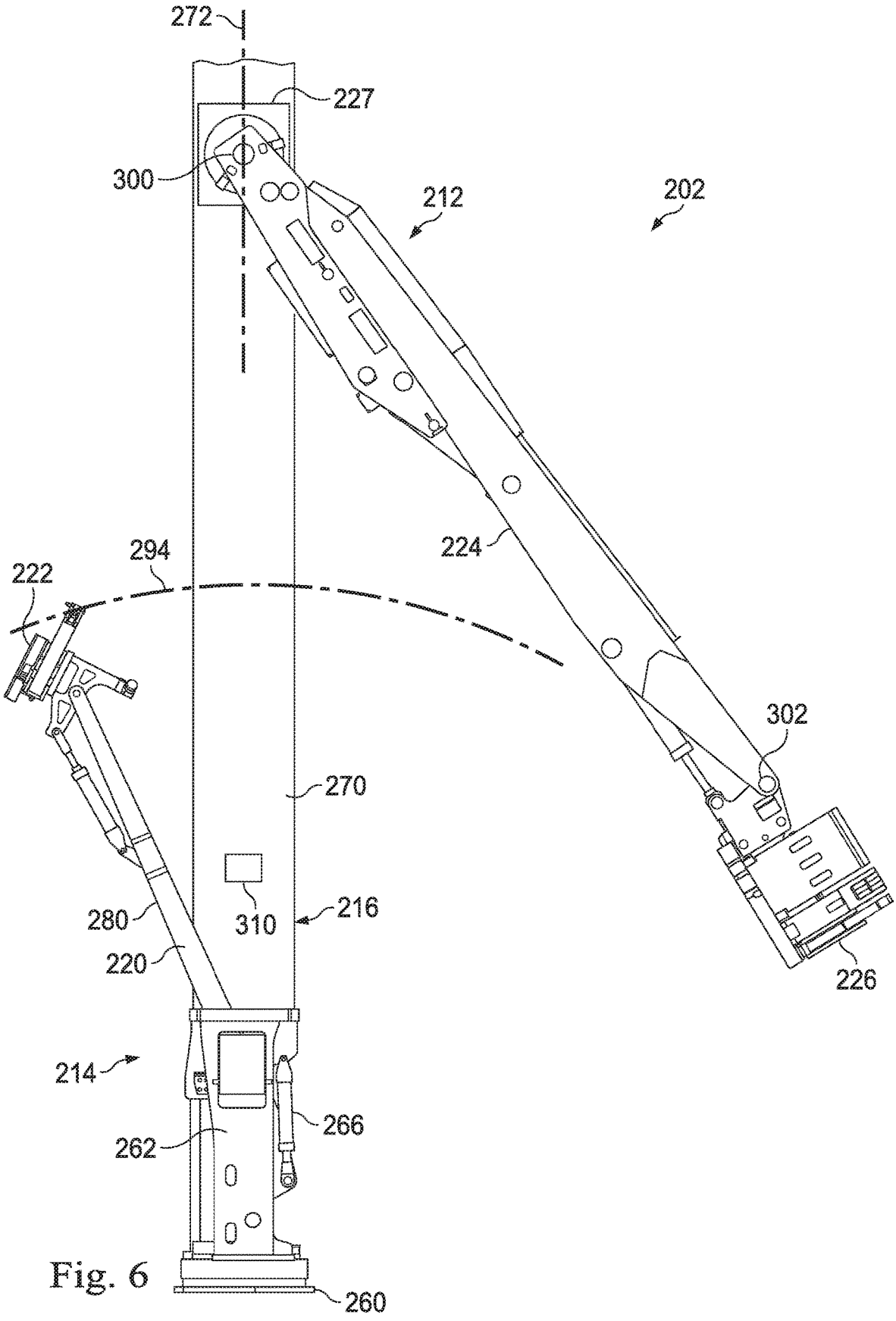
FIG. 6 is a schematic of a side view of a portion of the exemplary drilling apparatus showing the lower arm assembly and an upper arm assembly according to one or more aspects of the present disclosure.

FIG. 6 shows the lower manipulator arm 220 in the retracted position 280 positioned relative to the upper arm assembly 212. Again, one of the vertically extending struts 270 is removed for clarity. The upper arm assembly 212 may be raised or lowered vertically via the racker hoist 210 (FIG. 2). In FIG. 6, the upper manipulator arm 224 and the upper gripper head 226 extend from a movable carriage 227. The movable carriage 227 may be raised or lowered via the racker hoist. In some implementations, the movable carriage 227 may be configured to vertically move along the tracks or rails attached to or formed in the vertically extending struts 270.

The upper manipulator arm 224 and the upper gripper head 226 may be pivoted about pivot points 300 and 302 respectively. Actuators (not shown) may drive the upper manipulator arm 224 and the upper gripper head 226 in a manner similar to the operation of the actuators 266, 276 used to manipulate the lower manipulator arm 220 in the lower gripper head 222. FIG. 6 also shows the travel path 294 of the lower manipulator arm 220. In this implementation, the upper manipulator arm 224 and the upper gripper head 226 both extend into the travel path 294 of the lower manipulator arm 220 and the lower gripper head 222.

In some implementations, the upper gripper head 226 may have a C-shaped opening including jaws that can open and close to capture an upper end of a tubular of a stand. Accordingly, the upper gripper head 226 may be configured to secure an upper end of a tubular, and, by elevating the upper arm assembly 212 in the vertically upward direction, raise the upper end of the tubular so that the tubular is in a substantially vertical condition.

FIG. 6 also shows a carriage stop 310. In this embodiment, the carriage stop 310 is disposed on the inner surface of the vertically extending struts 270, and forms a mechanical stop that prevents excessive downward travel of the upper arm assembly 212. That is, the carriage stop 310 interferes with movement of the movable carriage 227 and prevents the movable carriage 227 from moving into lower manipulator arm when the lower manipulator arm 220 is in the retracted position 280. As can be seen here, the carriage stop 310 is disposed lower than the travel path 294 of the lower manipulator arm 220. In addition, as can be seen, the upper arm assembly 212 extends into the travel path of the lower manipulator arm 220. In some implementations, the carriage stop 310 is disposed equal with or higher than the travel path 294 of the upper arm assembly. Although shown on one vertically extending strut 270, in some implementations, another carriage stop may be disposed on the other vertically extending strut that is not shown in FIG. 6.

Figure 7:
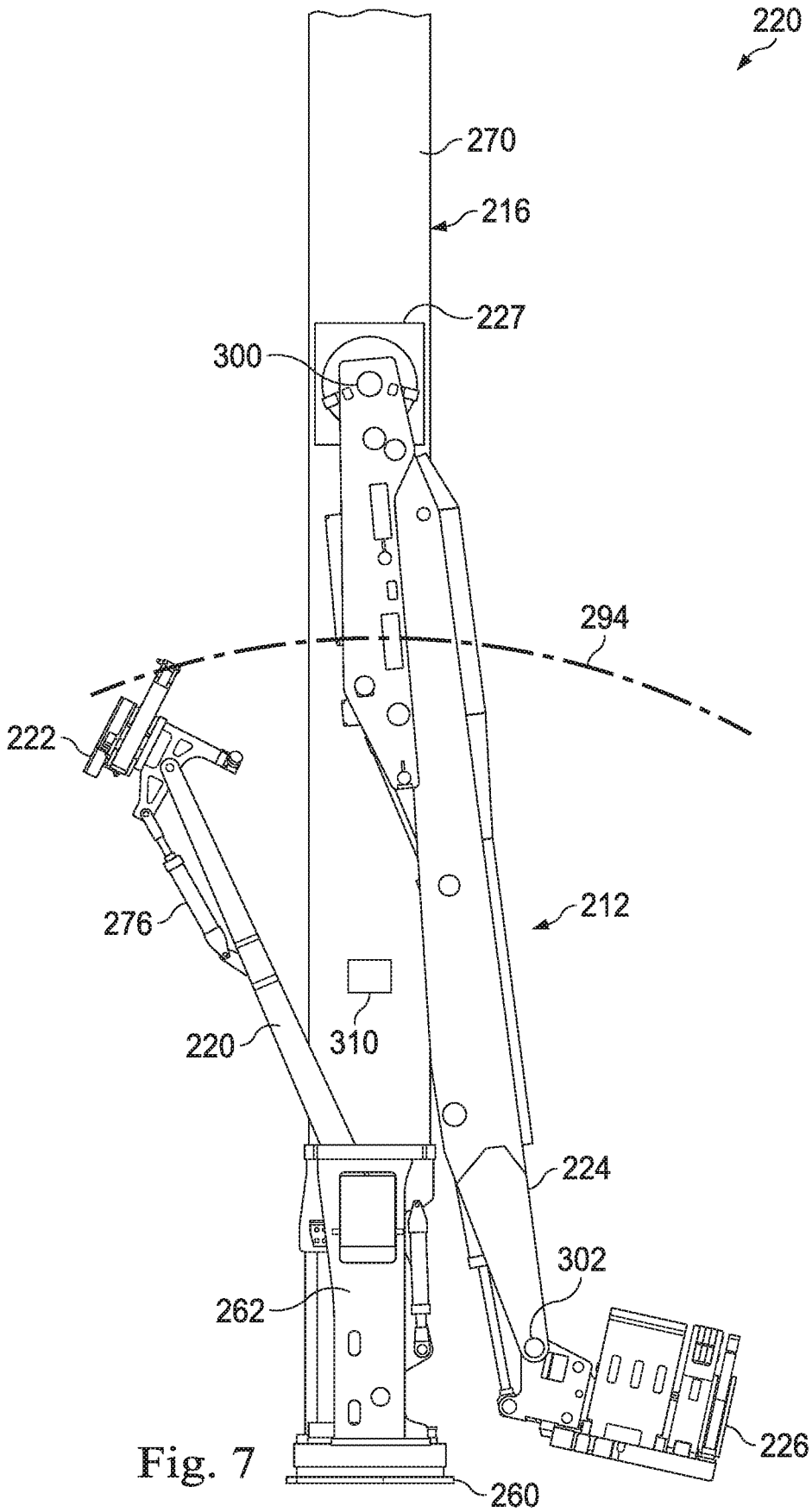
FIG. 7 is a schematic of a side view of a portion of the exemplary drilling apparatus showing the lower arm assembly and the upper arm assembly according to one or more aspects of the present disclosure.

FIG. 7 shows the lower manipulator arm 220 and the upper arm assembly 212. Compared to FIG. 6, FIG. 7 shows the upper arm assembly 212 in a position ready to receive a tubular being introduced to a drill rig floor. In this implementation, the upper arm assembly 212 has moved downward along the vertically extending struts 270, and a portion of the upper arm assembly is disposed within the travel path of the lower manipulator arm 220 and the lower gripper head 222. In some implementations, the movable carriage 227 may move down to and abut against the carriage stop 310 and may be disposed within the travel path of the lower manipulator arm 220 and the lower gripper head 222. Accordingly, the upper arm assembly 212 has reached its lowest limit. As can be seen, the upper manipulator arm 224 is rotated so that the upper gripper head 226 is below the lower manipulator arm 220 and the lower gripper head 222. In this position, the upper gripper head 226 is disposed adjacent the rig floor, in a position ready to receive a tubular being introduced to the rig floor. In the example shown, the upper gripper head 226 may be arranged with an upward facing opening configured to receive an end of a tubular of a stand. In some implementations, the upper gripper head 226 may rotate relative to the upper manipulator arm 224 about the pivot point 302. Because the upper gripper head 226 may have an opening that faces upward when in the position shown in FIG. 7, and because the upper gripper head 226 may have its opening facing a lateral direction when holding a tubular, and since the manipulator arm may pivot about the pivot point 300 to where the manipulator arm 224 extends upwardly, the gripper head 226 may be rotatable relative to the upper manipulator arm 224 within a range of about 170° to about 300°. In some implementations, the gripper head may be rotatable relative to the upper manipulator arm within a range of about 130° to about 300°. Some embodiments, the upper gripper head 226 may pivot about the pivot point 302 within a range of about 105° to about 300°. Because of the range of pivot and because the upper arm assembly 212 may approach or be adjacent the drill rig floor, the need for dangling equipment to secure a tubular with the upper manipulator arm, as do conventional devices, may be eliminated.

Figure 8:
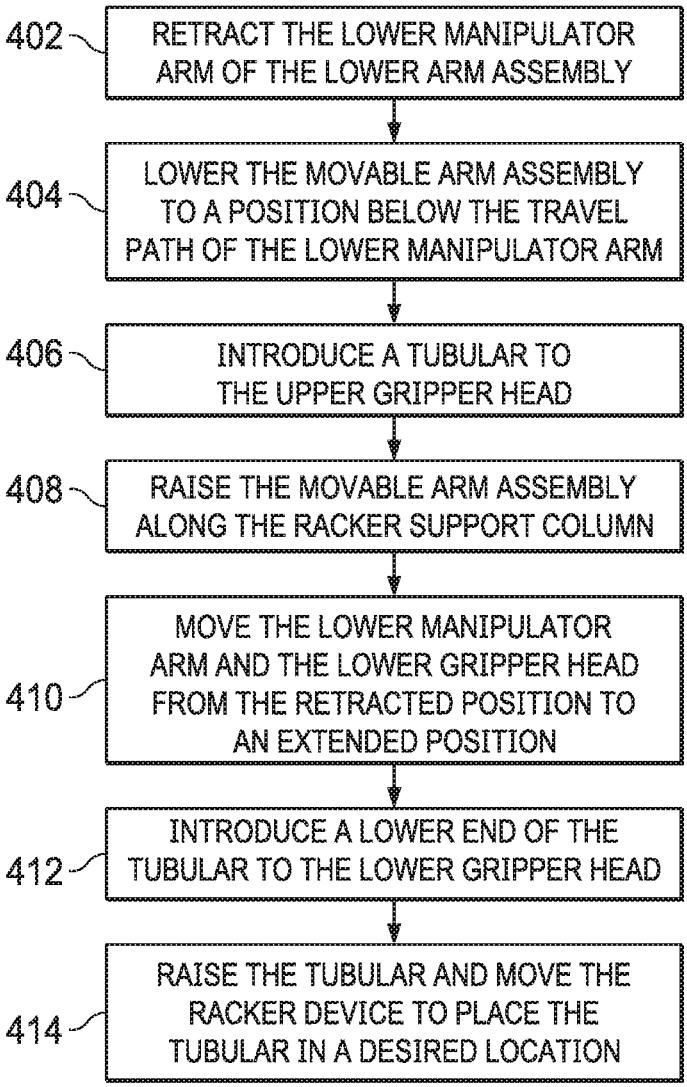
FIG. 8 is a flowchart diagram of a method of operating a drilling system according to one or more aspects of the present disclosure.

FIG. 8 shows an exemplary method of introducing a tubular to a drilling rig apparatus. The method includes utilizing the racker device 202 as described herein to receive and grasp a tubular so that it can be moved or manipulated to accomplish a desired drilling process. The example method of FIG. 8 corresponds to example actions shown in FIGS. 9A to 9E. Accordingly, the method of FIG. 8 will be described with reference to FIGS. 9A to 9E. in some implementations, the method of FIG. 8 is carried out by the controller 190 in FIG. 1. Accordingly, the method may be automated, reducing or eliminating the need for personnel to be physically on the drill floor about the column racker device 202 while performing drilling operations. In other embodiments, a user may control the racker device to perform independent steps and functions described herein.

Figure 9A:
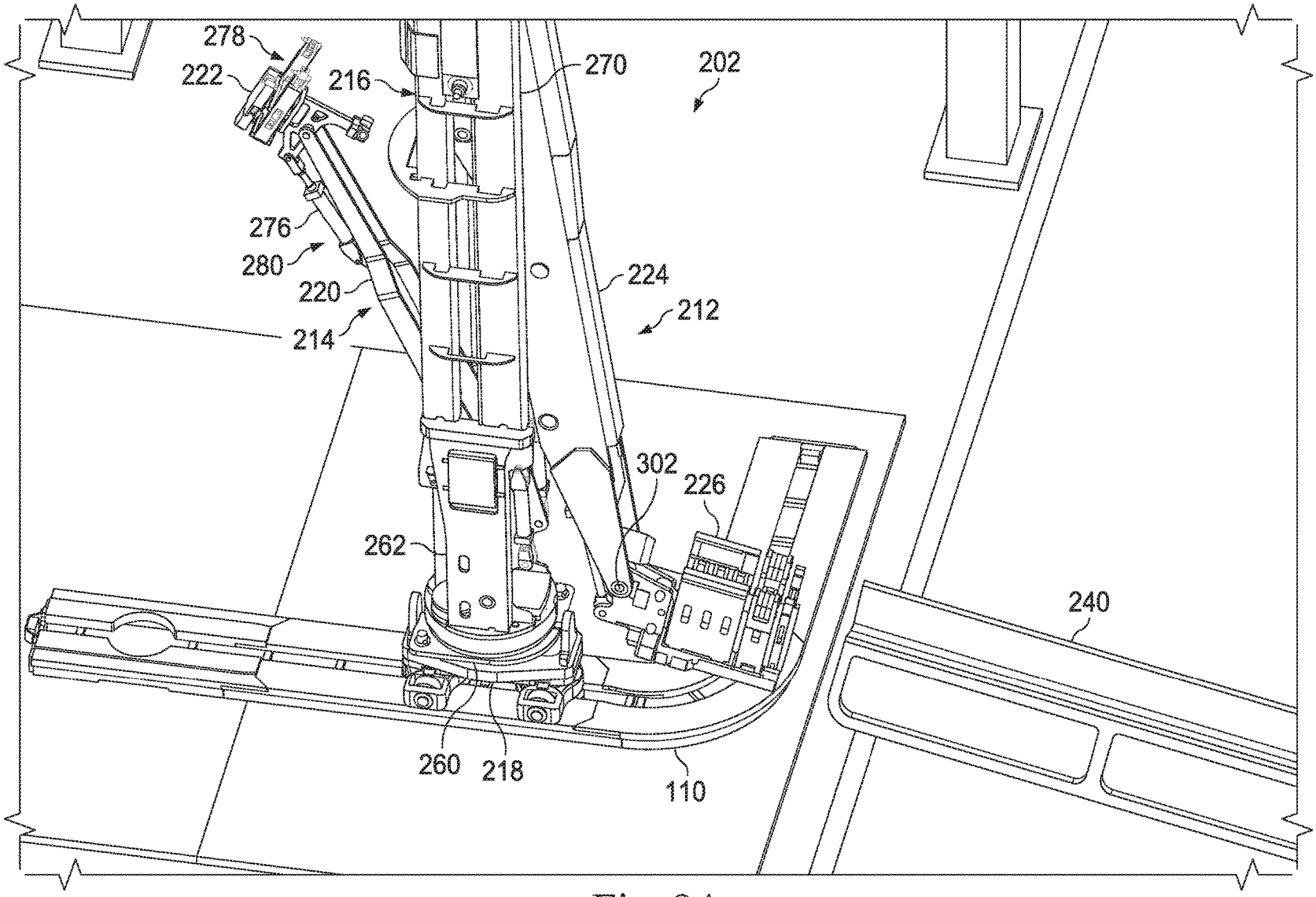
FIG. 9A is a schematic showing the exemplary drilling apparatus in operation according to one or more aspects of the present disclosure.
Figure 9B:
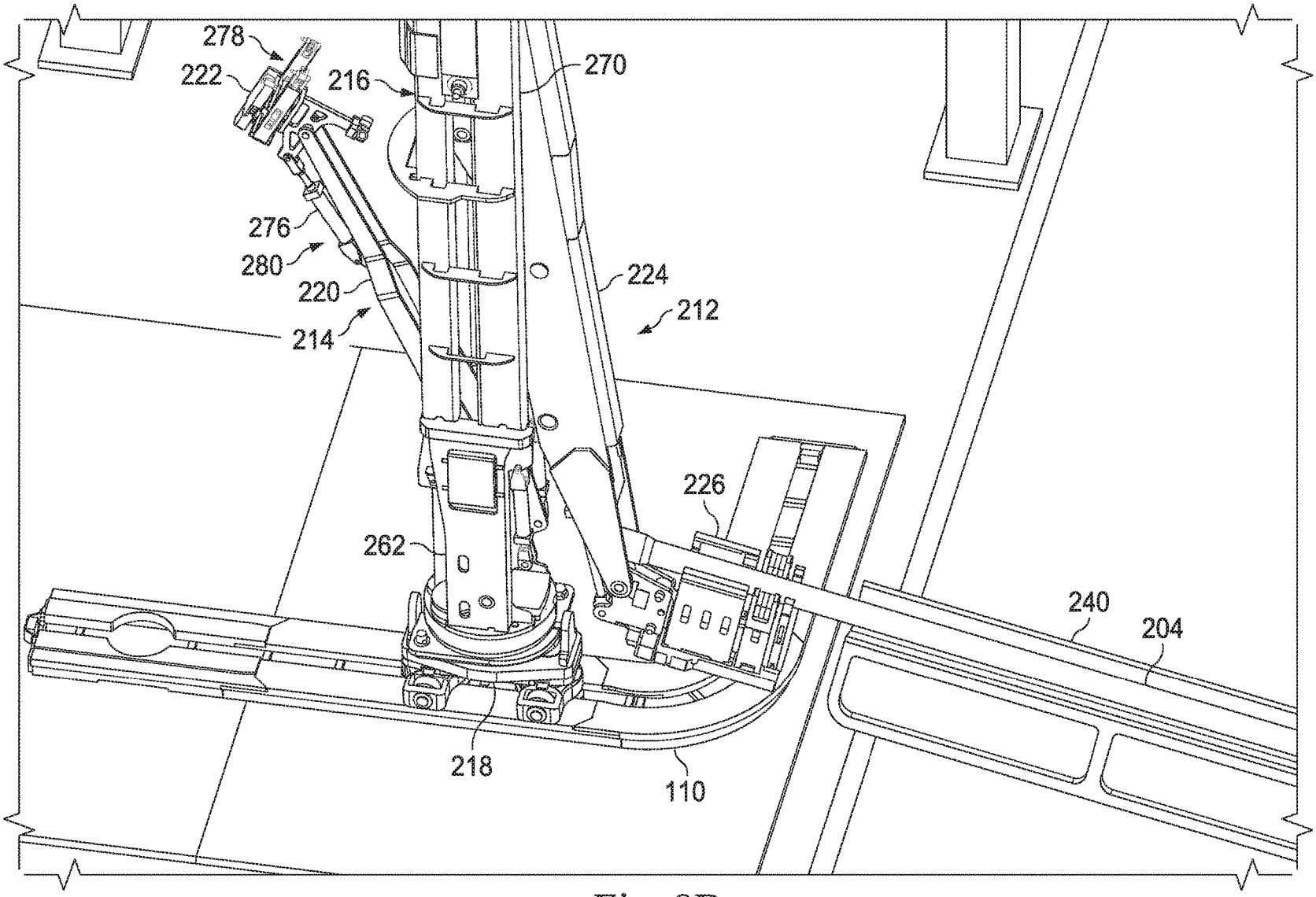
FIG. 9B is a schematic showing the exemplary drilling apparatus in operation according to one or more aspects of the present disclosure.

The method begins at 402 by retracting the lower manipulator arm of the lower arm assembly 214. This may include controlling the lower manipulator arm 220 so that it is disposed in the retracted position 280. As such, the lower manipulator arm 220 is disposed rearward of an axis defined by the racker support column 216. FIG. 9A shows the lower manipulator arm 220 and the lower gripper head 222 in the retracted position 280. Because the lower manipulator arm 220 is in the retracted position, the lower gripper head 222 is not disposed between the vertically extending struts 270, but rather, is disposed rearward of the vertically extending struts.

At 404 in FIG. 8, the controller lowers the upper arm assembly 212 so that at least a portion of the arm is in a position below the travel path (FIG. 6) of the lower manipulator arm 220. FIG. 9A shows the upper arm assembly 212 with the upper manipulator arm 224 and the upper gripper head 226 extended downwardly so that the upper gripper head 226 is disposed adjacent the drill floor. This may be referred to as a tubular receiving position for the upper gripper head. In this implementation, the upper gripper head 226 is disposed in contact or nearly in contact with the drill floor, including, for example, a track forming a part of the drill floor. In the implementation shown in FIG. 9A, the catwalk 240 extends through a V-door and is arranged to introduce a tubular to the drill floor. With the upper gripper head 226 in this position, the upper gripper head 226 may be configured to receive an end of a tubular directly from the catwalk 240. Accordingly, as can be seen in FIG. 9A, the upper gripper head 226 has an upwardly facing opening and is disposed adjacent an end of the catwalk 240. In some implementations, the upper gripper head 226 may be disposed adjacent an end of the catwalk 240 but may be displaced from the drill floor. For example, if the catwalk 240 is elevated a substantial distance above the drill floor, the upper gripper head 226 may be positioned at the proper elevation to properly receive the tubular from the catwalk 240.

At 406 in FIG. 8, the catwalk 240 may introduce a tubular to the upper gripper head 226. It may do this by advancing the tubular axially into the upwardly facing opening of the upper gripper head 226. In some implementations, the upper gripper head 226 may include opening and closing jaws that may secure an end of the tubular within the upper gripper head 226.

Figure 9C:
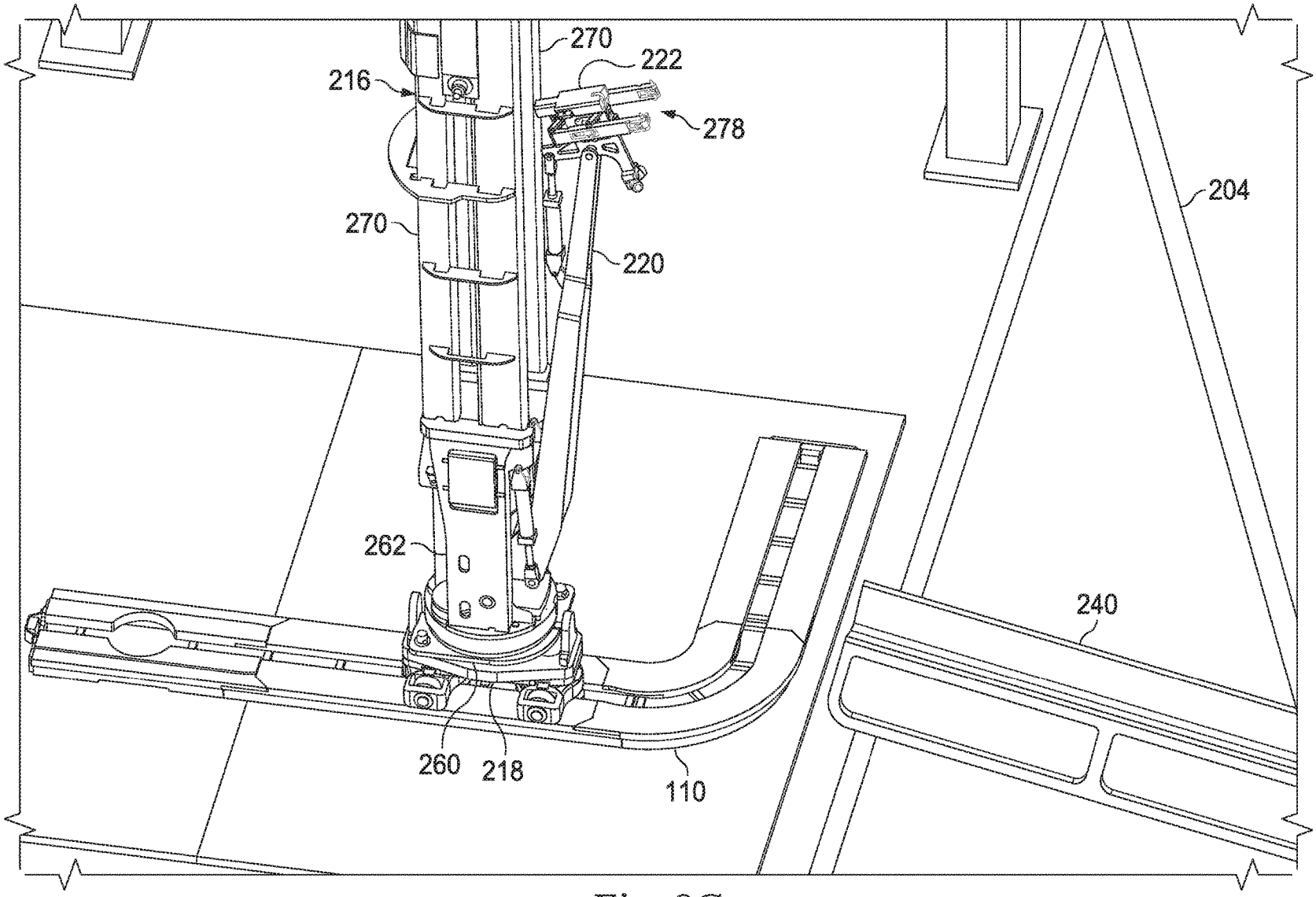
FIG. 9C is a schematic showing the exemplary drilling apparatus in operation according to one or more aspects of the present disclosure.

At 408, with the tubular secured in the upper gripper head 226, the upper arm assembly 212 may be raised from the tubular receiving position to a position out of the travel path of the lower manipulator arm 220 and the lower gripper head 222. This may be done using the modular racker hoist 210. As such, the tubular end secured in the upper gripper head 226 may rise along the racker support column 216, and in some embodiments, may rise between the vertically extending struts 270. With the upper arm assembly 212 above the travel path 294, the lower manipulator arm 220 may be brought forward from the retracted position 280 between the vertically extending struts 270 to the extended position 284, at 410 in FIG. 8. Likewise, the lower gripper head 222 may be poised to receive a lower end of the tubular now being raised by the upper arm assembly to 12. FIG. 9C shows the lower manipulator arm 220 and the lower gripper head 222 transitioning towards the extended position 284.

Figure 9D:
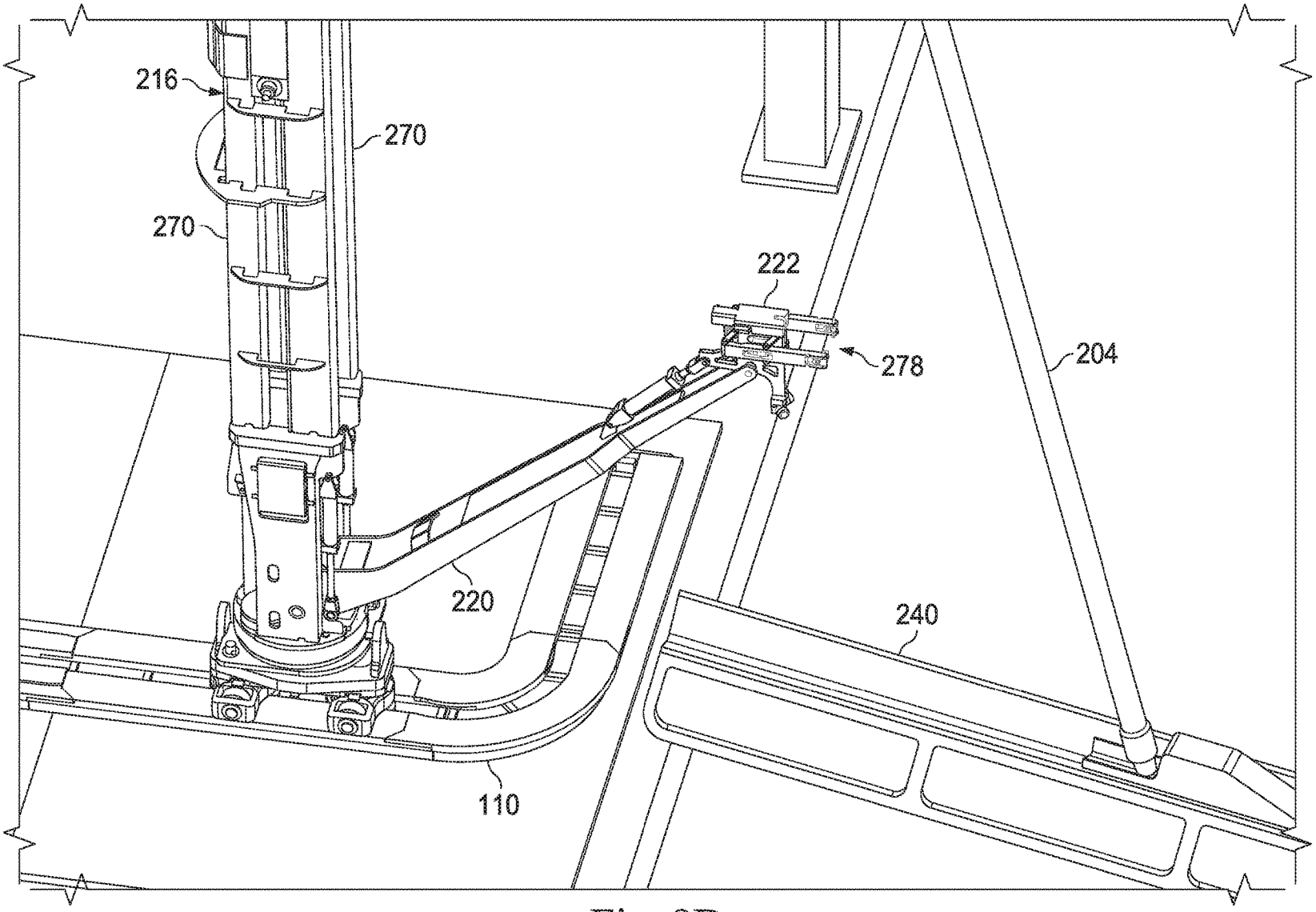
FIG. 9D is a schematic showing the exemplary drilling apparatus in operation according to one or more aspects of the present disclosure.

At 412 in FIG. 8, the catwalk 420 continues to push the lower end of the tubular toward the gripper head 222 until the lower end of the tubular is introduced into the lower gripper head. FIG. 9D shows the lower end of the tubular continuing to advance along the catwalk toward a position where it can be grasped by the jaws of the lower gripper head 222. As can be seen, the lower manipulator arm 220 in the lower gripper head 222 are in the extended position 284. When the lower end of the tubular is introduced to the lower gripper head 222, the jaws of the lower gripper head may be closed to secure the lower end of the tubular in place.

Figure 9E:
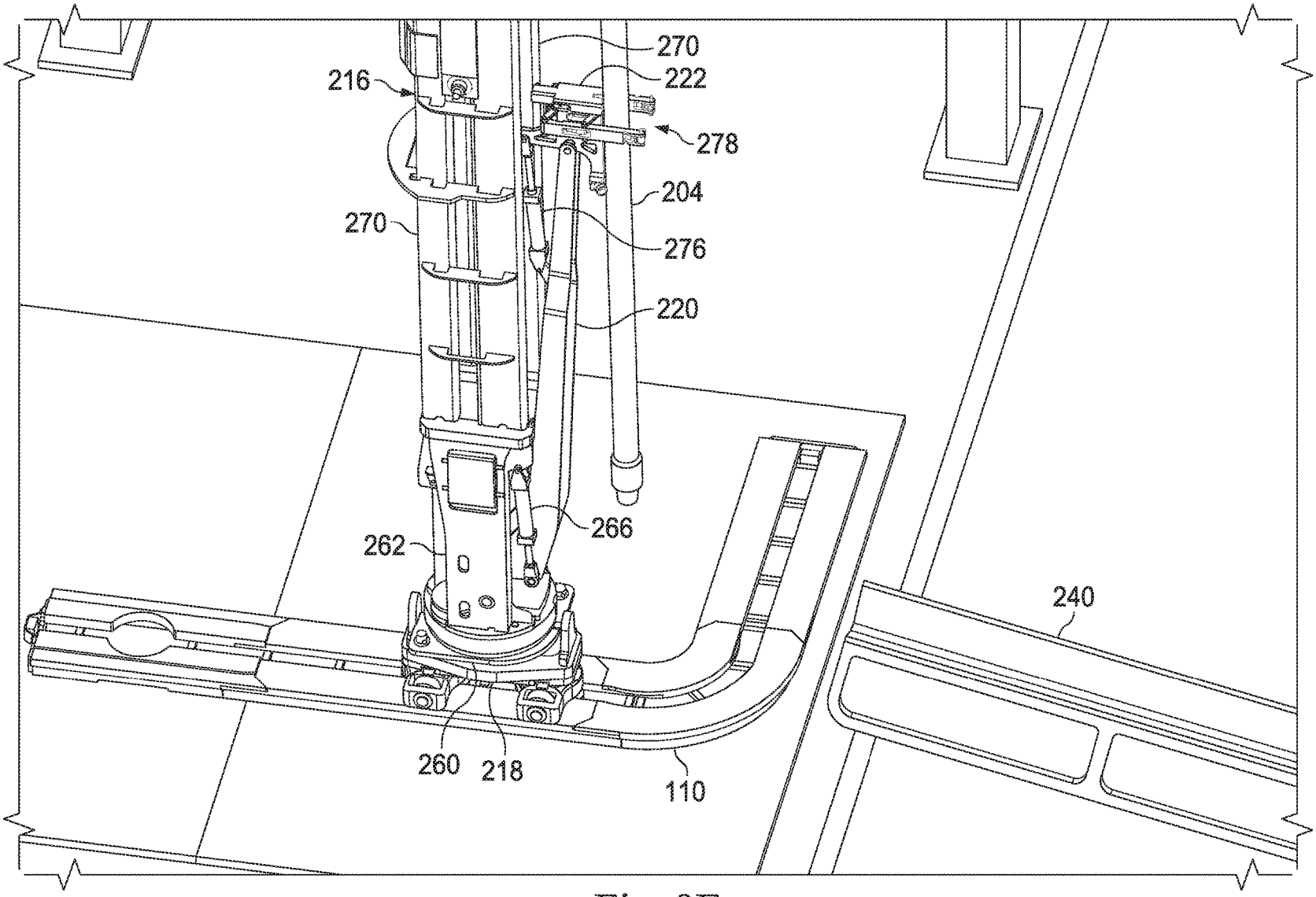
FIG. 9E is a schematic showing the exemplary drilling apparatus in operation according to one or more aspects of the present disclosure.

At 414, the upper arm assembly 212 may continue to raise the tubular from the catwalk to a substantially vertical position, relatively parallel to the racker support column 216. FIG. 9E shows the tubular secured by the lower gripper head 222. In this position, the racker device 202 can move along the drill floor to a desired location and may extend the upper manipulator arm and lower manipulator arm to present the tubular to the fingerboard, well center, a mouse hole for stand building, or other location desired by the operator. Although the method of FIG. 8 is directed to introducing a tubular to a drill rig apparatus, in other implementations, the tubular or stand may be removed from the drilling rig apparatus by operating the system in a reverse order.

Figure 10:
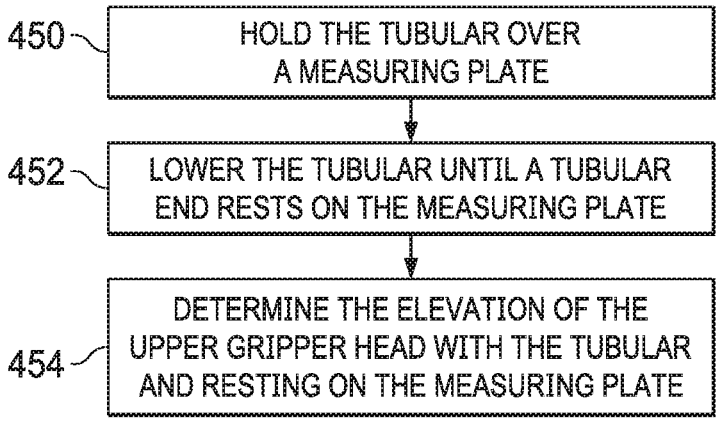
FIG. 10 is a flowchart diagram of a method of determining a length of a tubular according to one or more aspects of the present disclosure.

In some implementations, the racker device 202 may be configured to measure the length of a tubular or a stand. Such a method is described with reference to FIG. 10. Measuring the length of the tubular or stand may provide information indicative of the where or useful life remaining in the measured tubular or stand. The racker device may then be able to provide an accurate length of the tubular, thus being able to identify stands for further review that exceed their original length.

The method may begin by performing the steps described with reference to FIG. 8, or may be performed while tripping out of a well or at other times during a drilling process. The method may begin at 450 in FIG. 10. At 450, the racker device 202 may hold the tubular over a measuring plate. As indicated with reference to 414 in FIG. 8, the tubular may be held by both the lower arm assembly 214 and the upper arm assembly 212. For example, an upper end of the tubular may be held in place by the upper gripper head 226, in the lower end may be secured by the lower gripper head 222. The upper gripper head 226 may secure the tubular beneath a tubular shoulder so that the relative position of the upper gripper head 226 and the end of the stand is known. In some embodiments, the measuring plate may be simply a designated portion on the drill rig floor. In other implementations, the measuring plate may be some other solid structure sufficiently strong to support the weight of the tubular.

At 452, the racker device 202 may lower the tubular until the lower end rests on the measuring plate. At 454, with the tubular resting on the measuring plate, the control system may determine the distance between the measuring plate and the upper gripper head 226. That distance may be reflective of the total height of the tubular. In some implementations, the total height of the tubular may be then compared to a table indicating an acceptable height of the tubular. If the tubular were to fallout of the acceptable range, the system may notify an operator to not use the tubular in the drill string.

In view of the disclosure herein, the present disclosure may be generally directed to: an apparatus for moving a tubular that includes a column vertically extending from a drill floor with the column defining an axis. An upper arm assembly may be movable along the column and may be configured to connect with a tubular. A lower arm assembly may have a lower gripper head configured to attach to the tubular. The lower arm assembly may be movable to displace the lower gripper head between a position on a first side of the axis and a position on a second side of the axis.

In some aspects, a lower carriage connected to the column, the lower carriage being arranged to rotate at least 180 degrees. In some aspects, the lower carriage is configured to carry the column along the drill floor. In some aspects, the column comprises two vertical struts, the lower gripper head being movably disposed to pass between the two vertical struts. In some aspects, the upper arm assembly comprises: a carriage movable along the struts forming the column; and an upper manipulator arm, the upper manipulator arm attached to and extending from the carriage. In some aspects, the lower arm assembly comprises a lower manipulator arm configured to pivot relative to the column to displace the lower gripper head between the position on the first side of the axis and the position on the second side of the axis. In some aspects, the lower arm assembly is movable through a motion range, and the upper arm assembly selectively extends into the motion range. In some aspects, the upper arm assembly comprises an upper gripper head, the upper gripper head being movable to a location adjacent the drill floor. In some aspects, the upper gripper head of the upper arm assembly comprises an opening configured to receive a tubular, the opening facing upward when the upper gripper head is disposed adjacent the drill floor. In some aspects, the lower arm assembly comprises a lower manipulator arm pivotable through a motion range greater than 90°. In some aspects, a catwalk may be configured to introduce a tubular to the drill floor, the upper arm assembly comprising an upper gripper head movable to a position having an elevation lower than an elevation of the catwalk to receive the tubular. In some aspects, a control system may be configured to: measure a length of a tubular by securing a first end of the tubular with the upper arm assembly while a second end of the tubular rests on a measuring plate; determine a distance of the upper arm assembly from the measuring plate; and calculate the length of the tubular based on the distance of the upper arm assembly from the measuring plate. In some aspects, the measuring plate is the drill floor. In some aspects, the drill floor is a track, the lower arm assembly comprising a carriage movable along the track.

In an exemplary aspect, the present disclosure is directed to an apparatus for moving a tubular. The apparatus may include a column vertically extending from a drill floor, the column defining an axis; a lower manipulator arm having a gripper head configured to attach to the tubular; and an upper arm assembly movable along the column, the upper arm assembly being configured to connect with a tubular, the upper arm assembly being movable to a position adjacent the floor.

In some aspects, a lower carriage may be connected to the column, the lower carriage being arranged to rotate at least 180 degrees. In some aspects, the lower carriage is configured to carry the column along the drill floor. In some aspects, the lower manipulator arm is movable through a motion range, and a portion of the upper arm assembly selectively extends into the motion range of the lower manipulator arm. In some aspects, a catwalk may be configured to introduce a tubular to the drill floor, the upper arm assembly may include an upper gripper head movable to a position having an elevation lower than an elevation of the catwalk to receive the tubular. In some aspects, the upper arm assembly comprises a gripper head, the gripper head being movable to a location adjacent the drill floor. In some aspects, the gripper head of the upper arm assembly comprises an opening configured to receive the tubular, the opening facing upward when the upper gripper head is disposed adjacent the drill floor.

In some aspects, the present disclosure is directed to a method of moving a tubular. The method may include lowering an upper arm to a position below a catwalk; introducing the tubular to the upper arm; raising the upper arm; moving a lower arm to a position previously occupied by the upper arm; and securing the tubular with the lower arm tubular so that the tubular is held simultaneously with the upper arm and the lower arm. In some aspects, the method may include moving a gripper head of the lower arm from a position on a first side of an axis of a vertical column racker to a second opposing side of the axis. In some aspects, the vertical column racker may include spaced vertical struts, and moving the gripper head of the lower arm may include pivoting the lower arm between the spaced vertical struts.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus for moving a tubular, comprising:

a column vertically extending from a drill floor, the column defining an axis;

an upper arm assembly movable along the column, the upper arm assembly being configured to connect with a tubular; and a lower arm assembly having a lower gripper head configured to attach to the tubular, the lower arm assembly being movable to displace the lower gripper head between a first position on a first side of the axis and a second position on a second side of the axis, wherein the lower arm assembly is movable through a motion range, and the upper arm assembly selectively extends into the motion range.

2. The apparatus of claim 1, comprising a lower carriage connected to the column, the lower carriage being arranged to rotate at least 180 degrees.

3. The apparatus of claim 2, wherein the lower carriage is configured to carry the column along the drill floor.

4. The apparatus of claim 1, wherein the column comprises two vertical struts, the lower gripper head being movably disposed to pass between the two vertical struts.

5. The apparatus of claim 4, further wherein the upper arm assembly comprises:

a carriage movable along the struts forming the column; and an upper manipulator arm, the upper manipulator arm attached to and extending from the carriage.

6. The apparatus of claim 1, wherein the lower arm assembly comprises a lower manipulator arm configured to pivot relative to the column to displace the lower gripper head between the first position on the first side of the axis and the second position on the second side of the axis.

7. The apparatus of claim 1, wherein the upper arm assembly comprises an upper gripper head, the upper gripper head being movable to a location adjacent the drill floor.

8. The apparatus of claim 7, wherein the upper gripper head of the upper arm assembly comprises an opening configured to receive a tubular, the opening facing upward when the upper gripper head is disposed adjacent the drill floor.

9. The apparatus of claim 8, wherein the lower arm assembly comprises a lower manipulator arm pivotable through a motion range greater than 90°.

10. The apparatus of claim 1, comprising a catwalk configured to introduce a tubular to the drill floor, the upper arm assembly comprising an upper gripper head movable to a position having an elevation lower than an elevation of the catwalk to receive the tubular.

11. The apparatus of claim 1, further comprising a control system configured to: measure a length of a tubular by securing a first end of the tubular with the upper arm assembly while a second end of the tubular rests on a measuring plate; determine a distance of the upper arm assembly from the measuring plate; and calculate the length of the tubular based on the distance of the upper arm assembly from the measuring plate.

12. The apparatus of claim 11, wherein the measuring plate is the drill floor.

13. The apparatus of claim 1, wherein the drill floor is a track, the lower arm assembly comprising a carriage movable along the track.

14. An apparatus for moving a tubular, comprising:

a column vertically extending from a drill floor, the column defining an axis;

a lower manipulator arm having a gripper head configured to attach to the tubular; and an upper arm assembly movable along the column, the upper arm assembly being configured to connect with a tubular, the upper arm assembly being movable to a position adjacent the floor, wherein the lower manipulator arm is movable through a motion range, and a portion of the upper arm assembly selectively extends into the motion range of the lower manipulator arm.

15. The apparatus of claim 14, comprising a lower carriage connected to the column, the lower carriage being arranged to rotate at least 180 degrees.

16. The apparatus of claim 15, wherein the lower carriage is configured to carry the column along the drill floor.

17. The apparatus of claim 14, comprising a catwalk configured to introduce a tubular to the drill floor, the upper arm assembly comprising an upper gripper head movable to a position having an elevation lower than an elevation of the catwalk to receive the tubular.

18. The apparatus of claim 14, wherein the upper arm assembly comprises a gripper head, the gripper head being movable to a location adjacent the drill floor.

19. The apparatus of claim 18, wherein the gripper head of the upper arm assembly comprises an opening configured to receive the tubular, the opening facing upward when the gripper head is disposed adjacent the drill floor.

20. A method of moving a tubular, comprising:

lowering an upper arm to a position below a catwalk;

introducing the tubular to the upper arm;

raising the upper arm;

moving a lower arm to a position previously occupied by the upper arm; and securing the tubular with the lower arm tubular so that the tubular is held simultaneously with the upper arm and the lower arm.

21. The method of claim 20, comprising:

moving a gripper head of the lower arm from a position on a first side of an axis of a vertical column racker to a second opposing side of the axis.

22. The method of claim 21, wherein the vertical column racker comprises spaced vertical struts, and moving the gripper head of the lower arm comprises pivoting the lower arm between the spaced vertical struts.

* * * * *